US007032565B2

(12) United States Patent
Tagliafero

(10) Patent No.: US 7,032,565 B2
(45) Date of Patent: Apr. 25, 2006

(54) ROTARY COMBUSTION ENGINE WITH LATERAL THRUST BETWEEN OPPOSING AND ENGAGING COMBUSTION FLYWHEELS

(76) Inventor: François Tagliafero, Allee des Mimosas, St-Mandrier-sur-Mer F-83430 (FR)

( * ) Notice: Subject to any disclaimer, the term of this patent is extended or adjusted under 35 U.S.C. 154(b) by 0 days.

(21) Appl. No.: 10/515,904

(22) PCT Filed: May 28, 2003

(86) PCT No.: PCT/FR03/01607

§ 371 (c)(1),
(2), (4) Date: Jun. 16, 2005

(87) PCT Pub. No.: WO03/100230

PCT Pub. Date: Dec. 4, 2003

(65) Prior Publication Data

US 2005/0247270 A1 Nov. 10, 2005

(30) Foreign Application Priority Data

May 29, 2002 (FR) ..... 02 06531
May 28, 2003 (FR) ..... 03 06455

(51) Int. Cl.

| | |
|---|---|
| ***F01B 13/06*** | (2006.01) |
| ***F02B 53/00*** | (2006.01) |
| ***F02B 53/02*** | (2006.01) |
| ***F02B 53/06*** | (2006.01) |
| ***F02B 55/00*** | (2006.01) |
| ***F02B 57/08*** | (2006.01) |
| ***F02B 75/32*** | (2006.01) |
| *F01C 1/18* | (2006.01) |
| *F01C 19/10* | (2006.01) |
| *F01C 21/00* | (2006.01) |

(52) U.S. Cl. ..... 123/232; 123/238; 123/245; 123/212

(58) Field of Classification Search ..... 123/44 D, 123/202, 204, 212, 213, 218, 228, 232, 238, 123/241, 242, 244, 245, 246, 249; 418/206.1, 418/206.2, 206.5
See application file for complete search history.

(56) References Cited

U.S. PATENT DOCUMENTS 61,592 A * 1/1867 Williams ..... 418/206.5
3,538,893 A * 11/1970 Tinsley ..... 123/246

FOREIGN PATENT DOCUMENTS

| | | | |
|---|---|---|---|
| DE | 231015 | * | 3/1909 |
| DE | 231747 | * | 3/1924 |
| DE | 2012834 | | 9/1971 |
| FR | 2288863 | | 5/1976 |
| FR | 2577987 | | 8/1986 |
| NL | 7800803 | | 7/1979 |

* cited by examiner

*Primary Examiner*—Sheldon J Richter
(74) *Attorney, Agent, or Firm*—Dowell & Dowell, P.C.

(57) ABSTRACT

A modular revolving cylinder engine including at least two interdependent flywheels driven in rotation by a driving device (1) that rotates them in synchronization and in opposite directions. Each flywheel includes a plurality of equally spaced hollow pushrods that are reciprocally movable along stroke lines that are parallel and offset with respect to the central axis of rotation thereof and through which combustion gases from associated combustion chambers pass outwardly of the flywheels. End portions of the opposing pushrods engage during each rotation of the opposing flywheels during which time the oppositely directed combustion gases passing through the pushrods impinge on the outer end portion of the opposite pushrod to thereby provide thrust to drive the opposing flywheel in rotation in opposite directions.

20 Claims, 5 Drawing Sheets

ROTARY COMBUSTION ENGINE WITH LATERAL THRUST BETWEEN OPPOSING AND ENGAGING COMBUSTION FLYWHEELS

BACKGROUND OF THE INVENTION

1. Field of the Invetion

The present invention concerns the design of a modular revolving engine with tangential combustion power, functioning without a piston, or connecting rod, or crankshaft, or camshaft, or valve.

2. Description of the Related Art

Spark-ignition engines in use at the present time are still generally spark-ignition engines with reciprocating pistons, of which the mechanical principle saw the light of day more than a century ago.

However, it is known that this system presents the major drawback of delivering in four-stroke engines only an efficient drive phase of 12.5% and, in two-stroke engines, of 23.6%.

Hence a highly mediocre efficiency of this reciprocating system which is ageing and which should be replaced by a rotary system which is mechanically more logical, therefore finally and certainly more economical.

Moreover, these engines of obsolete technique are heavy and cumbersome and composed of many moving parts subjected to considerable thermal stresses by the unnecessary and parasitic intense frictions that they undergo.

In order to cause said engines to run more smoothly, the makers have been obliged to multiply the number of cylinders in order to overcome these parasitic and antagonistic idle times of each cycle.

Now, despite all sorts of improvements including, inter alia, ancillary devices for better filling of the cylinders, these even very sophisticated engines are very far from functioning flexibly and harmoniously.

It has therefore been sought whether a rotary system exploiting the power of the explosions tangentially might not be capable of replacing this obsolete reciprocating piston system in certain mechanical applications.

SUMMARY OF THE INVENTION

It is precisely the principal purpose of this invention to attempt to overcome all the drawbacks of the reciprocating piston engine which furnishes per cylinder in a four-stroke cycle only one drive stroke per two revolutions, while one sole module of this engine is capable of furnishing a plurality of drive strokes per revolution, hence a possible, very slow idling.

In order to exploit directly, i.e. in tangential manner, the power of the explosions, the technique in the design of this engine is to mount, offset from and parallel to a line passing through the center of each flywheel and at a strictly identical distance, units of elements or groups of components of the engine that are indispensable for the optimum recovery of this explosive power, these units being distributed at perfectly equal intervals about the periphery of the flywheels, each unit being positioned so that its own axis is parallel to the line at the centers of the flywheels and at a distance there from that is identical for all the units.

These units of elements being, with reference to the accompanying drawings, pushrod supports (5) communicating with their chamber (4) and holes for spark plugs (8), sliding hollow pushrods (7 and 7B) in their pushrod support (5) and their compression spring (6).

According to a first characteristic, this engine is composed of two intake flywheels (Va) perfectly in line in the same plane perpendicular to their respective axis, interdependent in rotation by a slide-free drive system (1) which rotates them in synchronization and at absolutely equal speed in opposite directions from each other.

These flywheels comprise on their periphery and at perfectly equal intervals, the same number of units offset in accordance with the technique explained hereinabove, comprising: pushrod supports (5) with chamber (4) and holes for spark plugs (8), sliding hollow pushrods (7) or (7B), compression springs (6).

These flywheels are fixed by their respective shaft on a rigid and non-deformable common support in order that the distance separating their centers, once adjusted, is invariable.

They each comprise as many slots (3) as chambers (4) and holes for spark plugs (8), and rotate freely via hubs or bearings on their hollow shaft which comprises the intake slot (2).

The drive system (1) which renders the two flywheels interdependent in rotation by rotating them in opposite directions with respect to each other, is wedged so that, upon each revolution of flywheel, each pushrod (7) of one flywheel always interlocks with the same pushrod (7B) which corresponds thereto of the other flywheel.

Furthermore, it is during this interlocking that the detonating flux penetrating at the same time via each intake shaft (9), simultaneously fills through the slots (2) and (3) each chamber (4) and its corresponding hollow pushrod (7) or (7B). The drive force is collected by a pinion meshed on the drive system (1) or by a coaxial shaft integral with one of the intermediate gears. Each pushrod (7 and 7B) comprises at the end of its duct a funnel-shaped narrowing acting as nozzle, allowing a higher outlet speed of the gases at the instant of the explosion, as well as a greater force of reaction applied on each pushrod. Moreover, the internal pressure being greater by the narrowing, the two interlocked pushrods undergo a greater thrust one towards 30 the other, promoting seal.

When the intake slot (2) and the slot of the chamber (3) are no longer corresponding, but before the two interlocked pushrods (7 and 7B) disconnect, a spark projects at each spark plug, causing the detonating flux with which the chambers (4) and the hollow pushrods (7 and 7B) are filled, to explode.

The violent increase in pressure of the gases generated by this explosion deflagrating forcefully through the ducts of the opposite pushrods, causes them to be spaced apart.

The pushrods being fast with the flywheels whose axes are immovable, these flywheels are therefore mechanically the destinations of this tangential force which causes them to rotate simultaneously in opposite directions.

The same process being repeated and being successively applied to the following interlocked pushrods, generates the rotary drive force.

BRIEF DESCRIPTION OF THE DRAWINGS

The accompanying drawings illustrate the invention.

DESCRIPTION OF THE PREFFERED EMBODIMENTS

Figure 1:
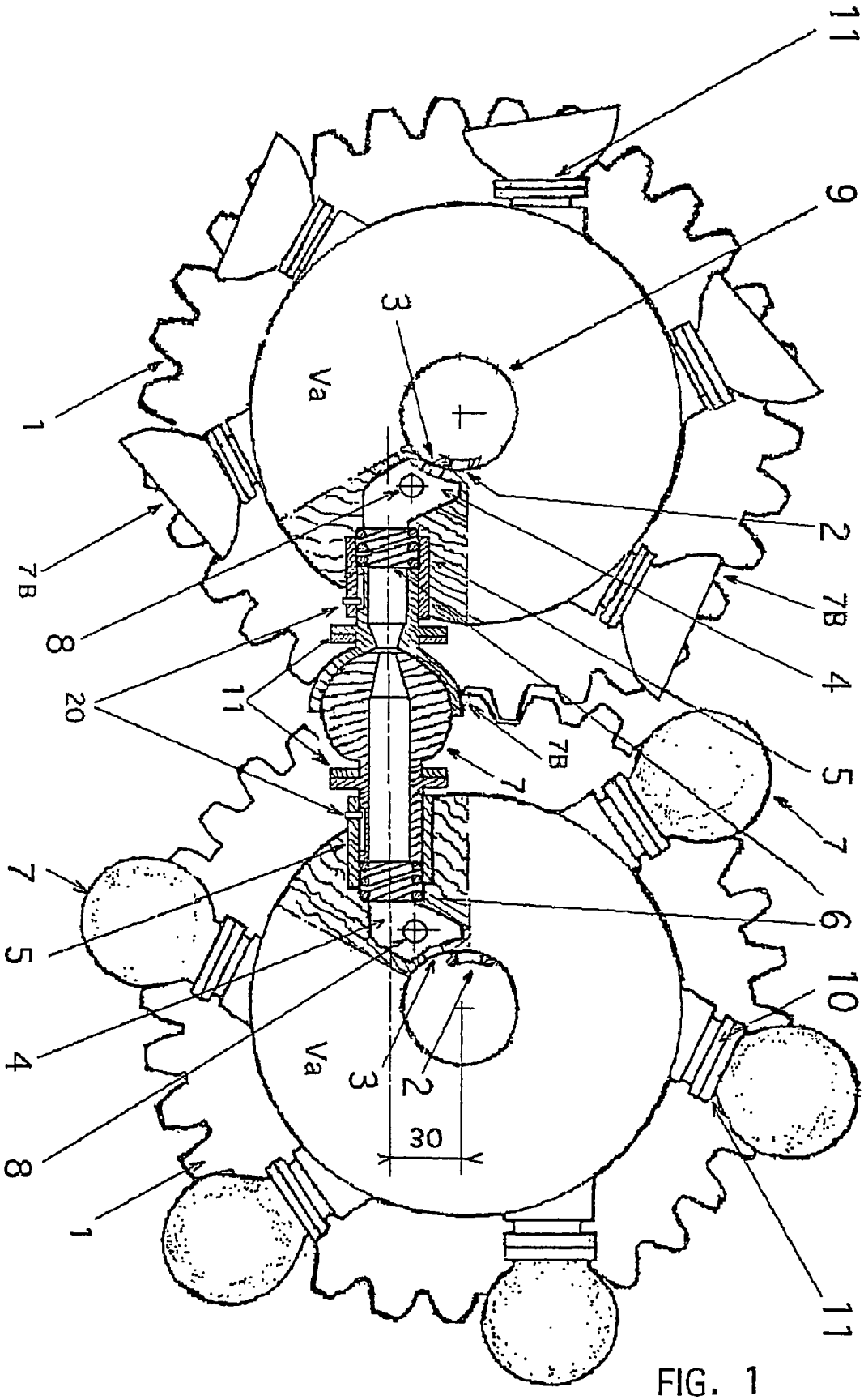
FIG. 1 shows an overall view and a partial section of the elements constituting the engine.

In the form of embodiment according to FIG. 1, the engine module comprises two intake flywheels (Va), a two-gear drive system (1) which renders these flywheels fast in rotation by causing them to rotate in opposite directions with respect to each other, twelve pushrod supports (5) and their catch (20), six sliding hollow pushrods (7) or (7B) with flange (10) and compression spring (6), twelve stirrup elements (15) and heel (21) rocker (16) with counterweight (12) shaft (14) spring (22).

Each intake flywheel (VA) rotates freely via hubs or bearings on its hollow shaft (9) which comprises the intake slot (2). This flywheel comprises six chambers (4) and their slot (3) six holes for spark plug (8) six pushrod supports (5) and catch (20) six hollow pushrods (7B or 7B) and compression spring (6) six stirrup elements (15) with heel (21) rocker (16) with counterweight (12) shaft (14) spring (22).

Figure 2:
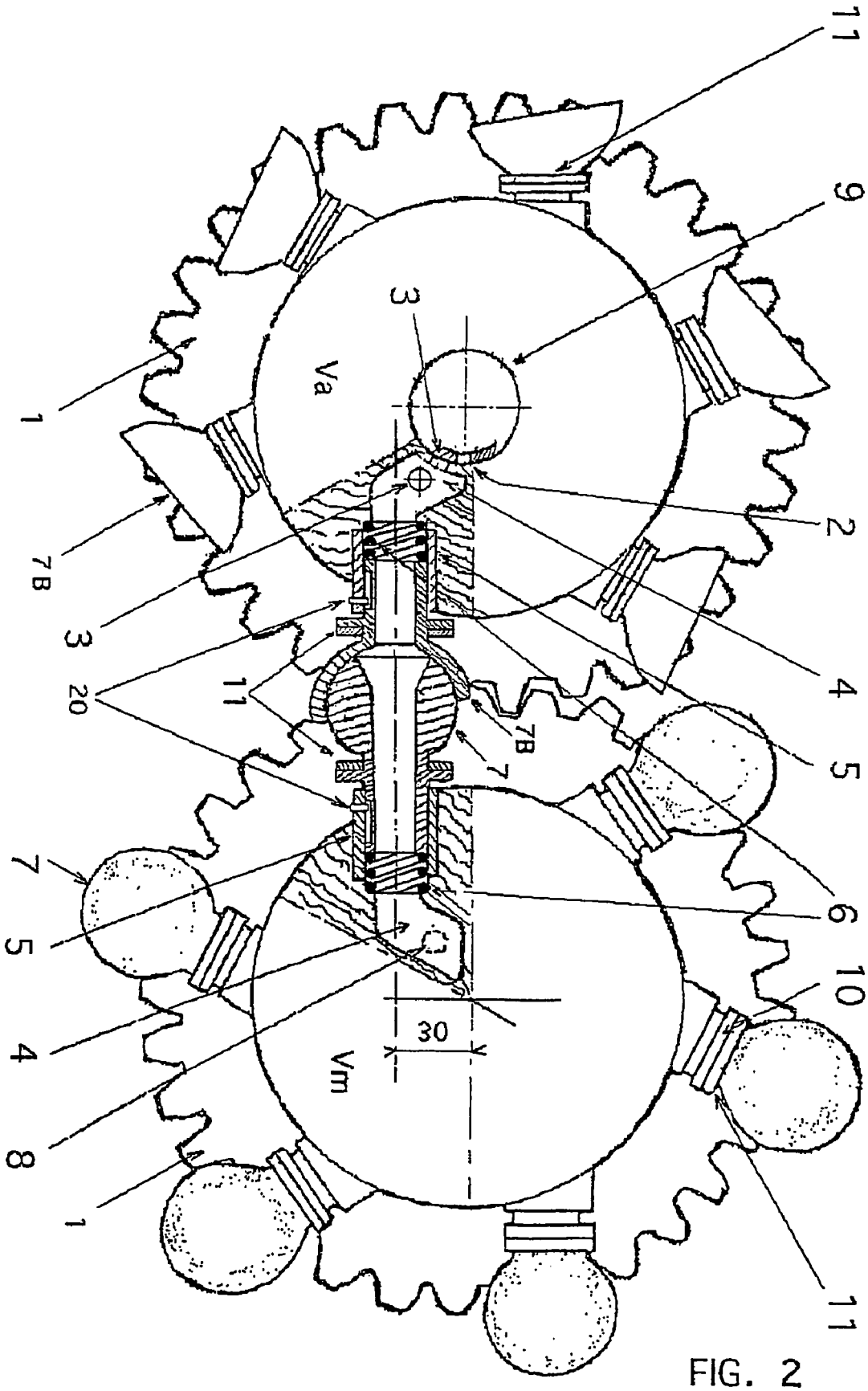
FIG. 2 shows an overall view and a partial section of the elements constituting a variant of this engine.
Figure 3:
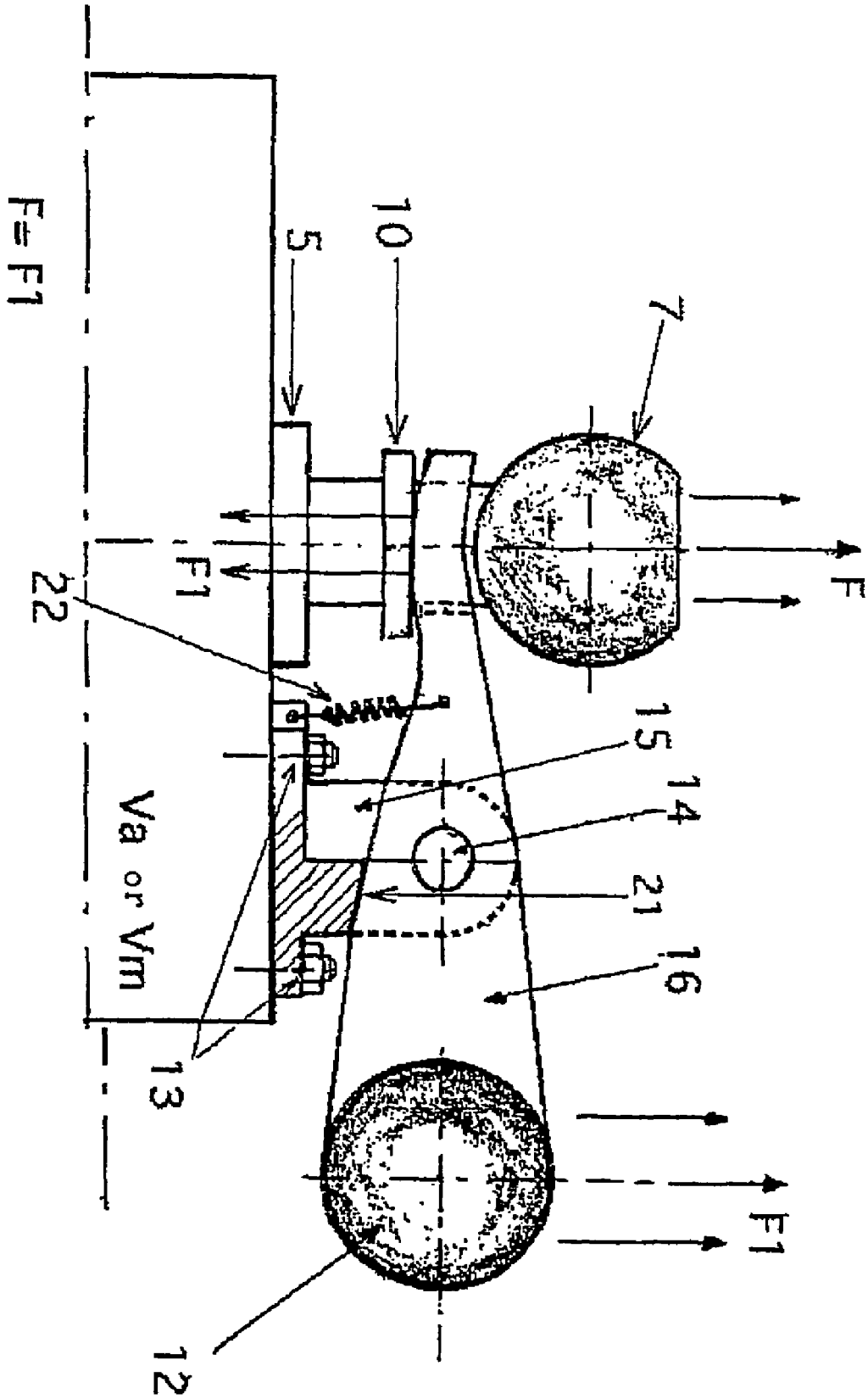
FIG. 3 shows a view of the rockers and their principle of functioning.
Figure 4:
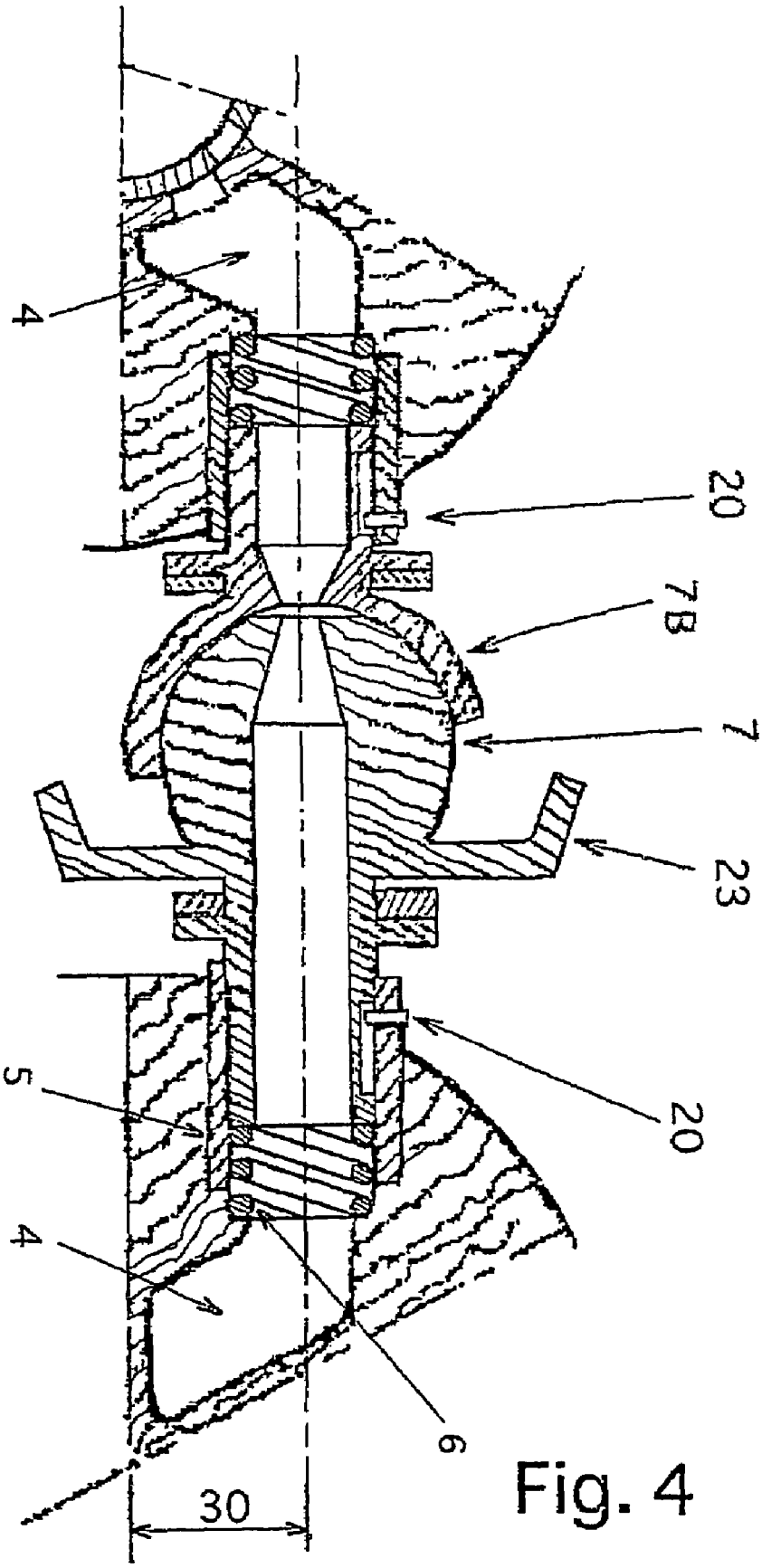
FIG. 4 shows in a particular embodiment of this engine an enlarged view of the catches on the pushrod supports and the location of the shield (23) on a ball-headed pushrod (7).
Figure 5:
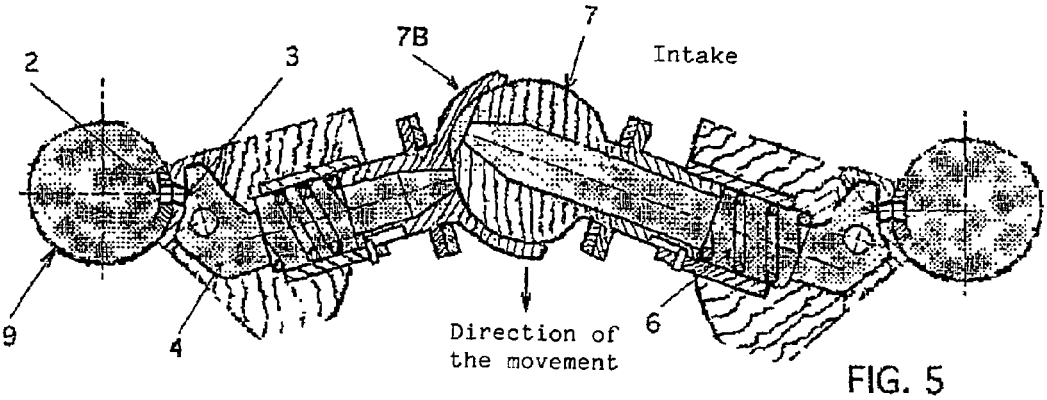
FIGS. 5–6 and 7 show the three consecutive strokes which form a drive cycle by each interlocking.
Figure 6:
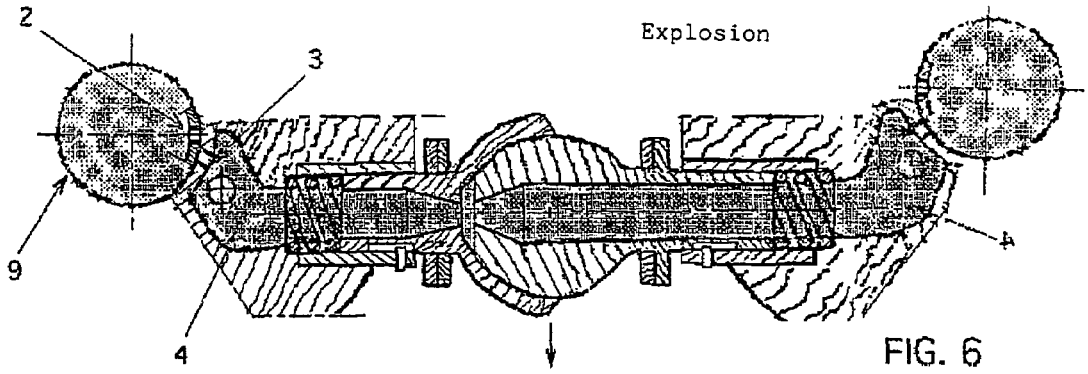
Figure 7:
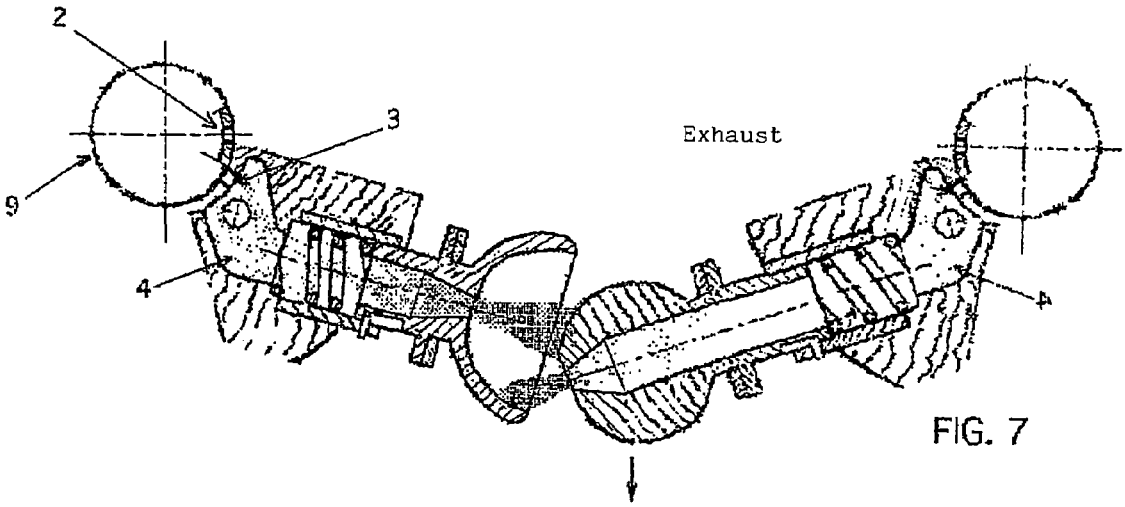

In the form of embodiment according to FIG. 2, this engine comprises an intake flywheel (Va), and a motive flywheel (Vm) pushrod supports (5) communicating with their chamber (4), pushrods (7) or (7B) and compression springs (6).

The motive flywheel (Vm) is fast with its shaft which rotates on bearings.

According to particular, non-limiting forms of embodiment:

- The two flywheels (Va and Vm) may have variable profiles, shapes and dimensions, bearing equally well pushrods (7) or (7B) of which the end may be of variable, but identical, shape on each flywheel.
- The stroke of the pushrods (7 and 7B) may be limited either by a catch (20) fixed on the pushrod support (5) sliding in a housing of adequate length of the pushrod (7 or 7B) or by a heel (21) existing on the stirrup element (15) limiting the oscillation of the rocker and, on the same occasion, the stroke of the pushrod or by a flange formed by a nut and a counter-nut abutting on the edges of the hole of smaller diameter of the pushrod support (5).
- The rotation of the pushrods may be prevented either by the catch (20), or by the fork (11) of the rocker surrounding on either side of the flat portions provided on each pushrod or that the section of the pushrods be partly square, hexagonal, etc. sliding in a hole of the pushrod support of corresponding section.
- The centrifugal force to which the pushrods are subjected by the rotation of the flywheels may be limited by a flange (10) on which a slightly concave tail of the rocker (11) may abut as a fork, this rocker oscillating on the shaft (14) of its stirrup element (15) comprising a heel (21) which is fixed in correspondence of each pushrod. The other end of the rocker comprising a counterweight (12) whose mass is in relation with the mass of the pushrod (7 or 7B) or of the force to be compensated.
- The body of the pushrods and the intake shaft (9) on their cylindrical part and this latter over the periphery of its slot (2) may comprise sealing elements.
- The system of drive of the flywheels (1) may be two gears or gear trains (which in this case would facilitate the adjustment of interlocking of the pushrods independently of the primary diameter of these gears) being able to be of thickness and of magnitude different in two's and also of different toothings (spur, helical, double-helical, etc. . . . ).
- Each gear of the drive system (1) may be integral with its flywheel or added and maintained on the flywheel by an appropriate system of fixation and allowing circularly any positioning or possible adjustment.
- The shaft of the motive flywheel (Vm) may be machined with the flywheel or the two portions of shaft mounted and fixed on the flywheel by any means of fixation.
- The pushrod supports (5) may be mounted by force on the flywheels in accordance with refrigeration technology or screwed or welded, etc. . . .
- The spark at the spark plugs may be provoked by different mechanical or electronic, or partly mechanical and electronic ignitions, on-board or not on the flywheels.
- The stirrup elements (15) may be fixed on the flywheels by welding, by bolts, by pins and nuts, etc. . . .
- The rockers (16) may comprise a device ensuring permanent contact of the fork (11) on the flange (10), for example a coaxial spiral or tension spring at the front (22) or compression at the rear.
- There may be provided on the pushrods (7) to the rear of the end, a shield (23) designed with the pushrod or added, making it possible to exploit as best possible the power of the explosions and to limit their consequences.
- There may be provided a system for blocking the pushrods preventing at the instant of the explosion that they be rejected in the pushrod supports.

By way of non-limiting example: the flywheels having a diameter of 200 mm and the center of one being spaced at 290 mm from the other, the common axis of the pushrod supports-pushrods-compression spring units of elements is offset on each flywheel by 30 mm on a line parallel to the line through the center or in drawings 1 and 2, by the line parallel to the imaginary line joining the centers of the flywheels.

The end part of the hole of the ball-headed (7) and half-shell (7B) pushrods has a dimension of 6 mm for an internal hole of 12 mm.

This engine should be enclosed in a housing in order to avoid sound nuisances due to the explosions, with an exhaust outlet placed a little higher than the bottom, in order to allow recovery of the lubricant which must not be expelled by the exhaust.

Cooling of the housing may be effected by air with the aid of fins with which it may be provided during casting in the foundry or added or by circulation of water or of oil in its thickness or its double wall or any other adequate means.

In this engine, the greatest frictions being those generated by the interlocking of the pushrods (7) and (7B) and their short linear stroke, lubrication thereof may be effected, by way of example, by a mist of lubricant under pressure directed towards the pushrods and the pushrod supports.

This lubricant would easily be recovered in the bottom of the housing and reinjected into the system after having previously and possibly if necessary passed through a cooling radiator.

The ignition beams should be protected so that they are not exposed to the effect of the explosions.

That part of the pushrods (7 and 7B) ensuring interlocking contact, should be manufactured from very resistant materials (treated steel, titanium, etc . . . ) or partly coated with ceramics and anti-friction materials and comprising either grooves or one or more sealing rings.

The rockers and their counterweights may be manufactured from steel or steel-plated cast iron, the shafts from treated steel.

The flywheels may be manufactured from light materials (treated or steel-plated aluminum or composites) in order to obtain more nervosity, of from heavier material (steel or cast iron) to obtain more power.

Depending on its design, each engine forming a module functions with any, but an equal, number per flywheel, of pushrod supports with chamber, pushrods, rockers, etc . . . , generally from 3 to 6 per flywheel.

There may be formed engines of a plurality of combined engine modules of one of the two versions, either each of these engine modules offset angularly with respect to the preceding one in order to obtain rotary engines like turbines, or non-offset angularly in order to obtain a multiplied resultant of force of explosions or to make a mixture of offset and non-offset modules.

All combinations being possible as desired, in order to satisfy all requirements.

This engine is compatible for functioning with liquid and gaseous fuels.

The drive cycle is composed of three strokes:

1—Intake

2—Explosion

3—Exhaust

The invention claimed is:

1. A rotary combustion engine comprising; a pair of parallel hollow shafts, opposing flywheels mounted on each of the hollow shafts, each flywheel having a rotational axis which is parallel to the rotational axis of the opposing flywheel, drive connection means for engaging the pair of hollow shafts such that the shafts rotate at the same velocity but in opposite directions, each of the opposing flywheels including a plurality of equally spaced combustion chambers each having a fuel inlet that cooperatively receives fuel passing from an outlet in the corresponding hollow shaft as the flywheels and the hollow shafts rotate, a hollow pushrod support extending from each combustion chamber at an angle which is perpendicular to the rotational axis of the corresponding flywheel and toward the opposing flywheel, a hollow pushrod reciprocally mounted within each pushrod support for receiving combustion gases from the corresponding combustion chamber, each pushrod having an outer end portion extending from a periphery of the corresponding flywheel that includes a discharge opening therein through which the combustion gases are directed toward the opposing flywheel, and each pushrod having an elongated axis that extends parallel to but spaced at a distance from a line extending between the axes of rotation of the opposing flywheels such that exhaust gases exiting the pushrods is directed offset from the rotational axis of the opposing flywheel and in a direction to impinge on the end portion of an opposing pushrod of the opposing flywheel so as to drive the opposing flywheel in a direction opposite to the direction of rotation of the corresponding flywheel, resilient means for urging each pushrod toward an outermost position relative to the corresponding flywheel, and said outer end portions of the pushrods of one of said flywheels having a configuration to cooperatively receive the outer end portion of the opposing flywheel as the flywheels are driven in rotation by the combustion gases passing from the discharge openings of the pushrods.

2. The rotary engine of claim 1 wherein the outer end portion of each of the pushrods of one of the opposing flywheels includes a convex portion that cooperatively seats with a complementary concave portion of the outer end portions of the pushrods of the other of the opposing flywheels as opposing pushrods engage one another.

3. The rotary engine of claim 1 wherein the drive connections means includes at least one gear mounted to each of the hollow shafts that are intermeshed with one another.

4. The rotary engine of claim 1 wherein at least one of the flywheels is freely mounted to rotate relative to the corresponding hollow shaft.

5. The rotary engine of claim 1 including means for limiting a linear stroke of each pushrod within its respective pushrod support and means for preventing rotation of each of the pushrods within its respective pushrod support.

6. The rotary engine of claim 5 wherein said means to limit the stroke and the means to prevent rotation of the pushrods includes a catch mounted within the pushrod supports that is received within a slot within the pushrods.

7. The rotary engine of claim 5 including means for limiting a centrifugal force to which each pushrod is subjected.

8. The rotary engine of claim 7 wherein the means for limiting the centrifugal force of each pushrod includes a rocker pivotally mounted to the flywheel adjacent each pushrod, each rocker having a first end for engaging an inner surface of the outer end portion of the adjacent pushrod, a return spring means for urging the first end toward the periphery of the corresponding flywheel, a counterweight provided at a second end of the rocker, and a stop element for engaging the rocker to limit the pivotal motion of the rocker toward the corresponding flywheel.

9. The rotary engine of claim 8 wherein the means to limit the stroke of each pushrod includes the first end of the rocker being forked and engaging opposite flat surfaces formed along a portion of the pushrods adjacent the outer end portions thereof.

10. A modular revolving engine with tangential explosions, comprising; at least one intake flywheel (Va) and a motive flywheel (Vm) that are aligned in laterally opposing relationship, a slide-free drive system (1) which makes the at least one intake flywheel and the motive flywheel rotatably interdependent by causing them to rotate in opposite directions with respect to each other in a common plane that is perpendicular to their respective rotational axes, groups of components for the recovery of power from the explosions distributed at equal intervals along a periphery of each flywheel, each group of components including a hollow pushrod (7, 7*b*) reciprocally mounted within a hollow pushrod support (5) so that an inner portion of each pushrod communicates with a separate one of a plurality of combustions chambers (4) formed within each flywheel, each pushrod including an exhaust duct having a discharge opening oriented outwardly of the corresponding flywheel, each pushrod being positioned so that an elongated central axis thereof is parallel to a line passing through a line passing through a center of each flywheel and spaced at a distance (30) therefrom that is the same for all the groups of components, each group of components further including a compression spring (6) mounted on each flywheel so as to urge the pushrod of the corresponding group of components toward an outermost position thereof within the corresponding pushrod support so that outer portions of the pushrods carried by one of the flywheels engage with outer portions of aligned pushrods of the other opposing of the flywheels during each rotation of the opposing flywheels and such that during the engagement of the corresponding and aligned pushrods, the pushrods are driven in a linear stroke to their innermost positions within their pushrod supports, means for limiting the linear stroke of each pushrod, means for preventing rotation of each pushrod about a longitudinal axis thereof, means for limiting a centrifugal force to which each pushrod is subjected during the rotation of the flywheels, an ignition system within each combustion chamber, the at least one intake flywheel rotating freely on a hollow shaft (9) that includes an intake slot (2) that successively aligns with chamber slots (3) associated with each combustion chamber (4), and one of each of the opposing flywheels including pushrods (7) having ball-like outer end portions that are cooperatively seated within half-shell outer end portions (7B) of the pushrods (7B) of the opposing flywheel.

11. The engine according to claim 10, wherein the means for limiting the stroke of each of the pushrods and for preventing rotation of the pushrods includes a catch pin (20) fixed on the pushrod supports and penetrating in slots in the pushrods.

12. The engine according to claim 10 wherein the means for limiting the stroke of the pushrods includes a flange adjacent the outer portions of each pushrod that engage caps that are fixed on the pushrod supports.

13. The engine of claim 10 wherein the means for preventing rotation includes each pushrod having a non-circular cross section portion that cooperative fits within the pushrod supports having complementary non-circular cross sections.

14. The engine according to claim 10 wherein the pushrods and the intake shafts adjacent the intake slot include sealing elements.

15. The engine according to claim 10 wherein ends of the ducts of the pushrods include funnel-shaped outlets that function as nozzles.

16. The engine of claim 10 wherein the slide-free drive system includes each of the flywheels being mounted on parallel hollow shafts, and at least one gear mounted to each hollow shaft for meshing with at least one gear of the adjacent parallel hollow shaft.

17. The engine according to claim 10 wherein the engine comprises either one sole module, or banks of a plurality of modules angularly offset with respect to one another in order to obtain units rotating-like turbines, or non-offset in order to obtain a multiplied resultant of force of explosions, or to make a mixture of offset and non-offset modules.

18. The engine according to claim 10 including means for rotating each of the opposing flywheels in opposite directions of rotation.

19. The engine according to claim 10, wherein the means for limiting the centrifugal force of each pushrod is a rocker (16) with counterweight (12), each rocker being urged toward a corresponding flywheel by a spring (22), and each rocker oscillating on a shaft (14) support on a stirrup element (15) having a heel (21) for limiting motion of the rocker toward the corresponding flywheel.

20. The engine according to claim 19 wherein the means for preventing rotation of the pushrods includes each rocker includes a fork (11) of that engages opposing flat portions provided on each pushrods.

* * * * *